United States Patent [19]

Lin

[11] Patent Number: 4,800,812

[45] Date of Patent: Jan. 31, 1989

[54] AUTOMATIC TAPE CUTTER/STICKER

[76] Inventor: Shuh-Chin Lin, No. 5, 35th Alley, 4th Lane, An-Lo Rd., Chung-Ho City, Taipei, Taiwan

[21] Appl. No.: 904,162

[22] Filed: Sep. 5, 1986

[51] Int. Cl.[4] ..... B41F 13/56

[52] U.S. Cl. ..... 101/226; 101/288; 400/242; 400/613; 156/387

[58] Field of Search ..... 101/288, 328, 329, 224, 101/226, 376; 156/384, 385, 386, 387, 388, 510; 400/242, 613

[56] References Cited

U.S. PATENT DOCUMENTS

| | | | |
|---|---|---|---|
| 2,247,881 | 7/1941 | Hatfield | 400/242 X |
| 3,099,212 | 7/1963 | Sohn | 101/226 |
| 3,960,080 | 6/1976 | Adahan | 101/226 X |
| 4,011,813 | 3/1977 | Sams | 101/288 |
| 4,194,448 | 3/1980 | Becker et al. | 101/288 X |
| 4,252,060 | 2/1981 | Strausburg | 101/329 X |
| 4,385,958 | 5/1983 | Lang | 156/384 X |
| 4,469,526 | 5/1949 | Sloat | 101/226 |
| 4,544,437 | 10/1985 | Gilson | 101/228 X |
| 4,578,140 | 3/1986 | Nakajima | 156/384 |
| 4,579,466 | 4/1986 | Sato et al. | 156/510 X |
| 4,668,326 | 5/1987 | Mistyurik | 156/384 |

*Primary Examiner*—Charles A. Pearson
*Assistant Examiner*—James R. McDaniel
*Attorney, Agent, or Firm*—Browdy and Neimark

[57] ABSTRACT

An improved automatic tape cutter/sticker is composed of an outer housing, inner housing, side cover, plate spring, circular ring tube, printing equipment, rotating cutting equipment, compressing rod and tape. The device further includes a circular ring tube, in which two opposite plates of the four pieces of circular arc tube plates are smaller and shorter than the other plates for encasing tapes with smaller widths. Moreover printing equipment is installed on the left lower side of the inner housing, which is composed of character mold rolling cylinder, ink rolling cylinder, character mold rolling cylinder shaft and ink rolling cylinder shaft. The character mold rolling cylinder linked with character mold rolling cylinder shaft is driven by the tape, so that the ink rolling cylinder located around the ink rolling shaft is driven so that the ink adheres to the convex lines of the character mold rolling cylinder for printing it in the back side of the output tape.

9 Claims, 2 Drawing Sheets

AUTOMATIC TAPE CUTTER/STICKER

FIELD OF THE INVENTION

The invention is concerning an improved automatic tape cutter/sticker, especially concerning the improvement of the tapes encased the circular ring tube in the automatic tape cutter/sticker used in the range of stationary or office supplies and tape printing equipment is added to it so that it can be used for all tapes of different widths and any data which the user desires can be printed on the tapes.

BACKGROUND OF THE INVENTION

The conventional automatic tape-cutter or tape dispenser in the market have a circular ring tube used for encasing the tape which has brake and fixing functions for tapes with suitable widths, so that the tape on the equipment cannot rotate or swing but the tape will swing during the usage if the tape on the equipment has smaller width. As a result, the pasted tape moves curvedly and linear beautiful pasted tape can not be achieved. Moreover, the conventional tapes used in the automatic tape-cutter are transparent and blank and have pasting and closing functions only and no other application are available. This is a significant drawback to the conventional tape dispensers.

OBJECT OF THE INVENTION

The main object of the invention is to solve the defects of the conventional automatic tape-cutter and to provide an improved automatic tape cutter/sticker, wherein the circular ring tube used for encasing the tape is composed of original four pieces of circular arc tube plates, in which two opposite plates are changed to shorter ones for matching the fixing of the tape with smaller width, so that the tape with smaller width cannot swing during the usage and can be linearly pasted. Moreover, the rolling cylinder on the tape output rolling cylinder shaft is changed to a character rolling cylinder and an ink rolling cylinder shaft is installed on its neighboring parallel position. Around the ink rolling cylinder shaft an ink rolling cylinder is installed and its surface just contacts the character mold rolling cylinder. When output tape drives the character mold rolling cylinder, the ink rolling cylinder is synchronously driven so that the ink adheres to the convex character model on the character mold rolling cylinder, then it is printed on the back side of the tape and the tape is pasted on the desired position.

SUMMARY OF THE INVENTION

The present invention is composed of an outer housing, an inner housing, a side cover, a plate spring, a circular ring tube, printing equipment, rotating cutting equipment and a compressing rod. The improved parts are the circular ring tube and the printing equipment. The circular ring tube is composed of four pieces of circular arc ring tube plates and an X-shaped plate. The left and right circular arc tube plates are larger and longer for encasing tape with a standard width. The upper and lower circular arc tube plates are smaller and shorter for encasing tapes with smaller widths, so that the tapes do not swing during the output. The printing equipment is composed of a fixed character model rolling cylinder shaft, an ink rolling cylinder shaft, a character model rolling cylinder and an ink rolling cylinder. Using the friction force of tape output, the character model rolling cylinder is driven to drive further the ink rolling cylinder, so that the ink adheres to the surface on the character model rolling cylinder to be printed on the back side of the tape.

DETAILED DESCRIPTION OF THE INVENTION

Figure 1:
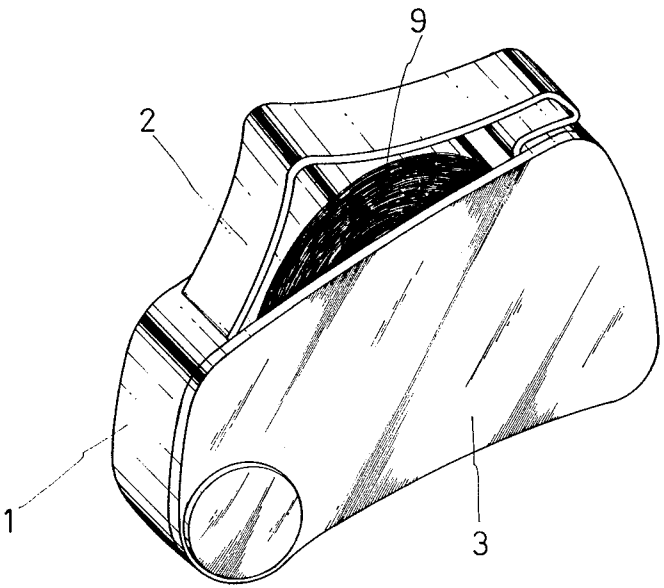
FIG. 1 is a cubic view illustrating the outer appearance of the present invention.
Figure 2:
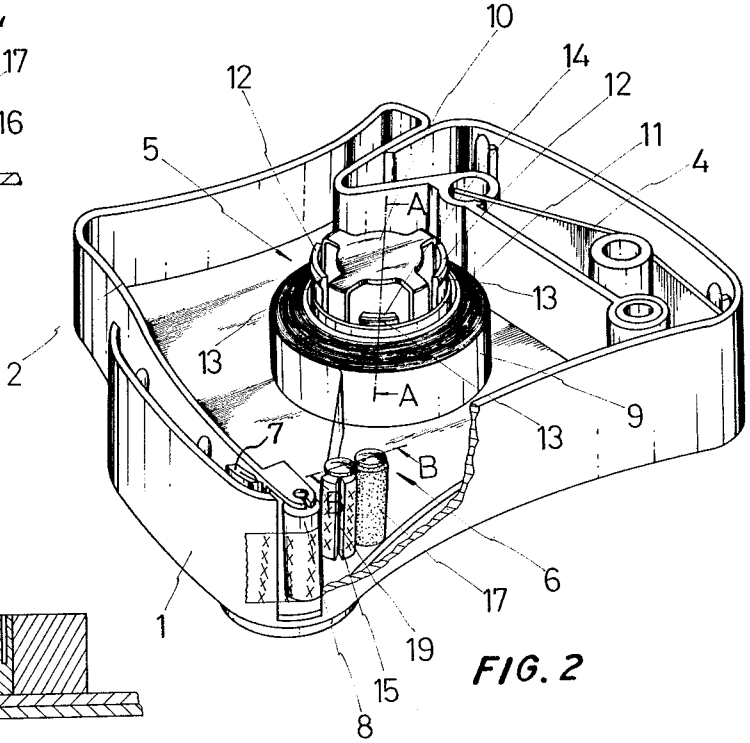
FIG. 2 is a cubic view illustrating the inner structure of the present invention the side cover is open.

Referring to the FIG. 1 and FIG. 2, this invention is composed of outer housing 1, inner housing 2, side cover 3, plate spring 4, circular ring tube 5, printing equipment 6, rotating cutting equipment 7, compressing rod 8 and tape 9. The improved parts of this invention are circular ring tube 5 and printing equipment 6. Besides the other conventional parts, these two parts are described in detail as follows.

Figure 3:
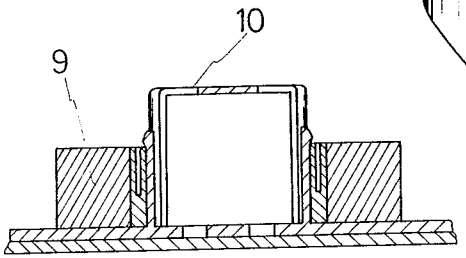
FIG. 3 is an A—A cross-sectional view of FIG. 2 in the present invention.

The circular ring tube 5 is installed in the middle of the inner housing 2 (as shown in FIG. 2), and is integrated with the inner housing 2. In the center of circular ring tube 5 is an X-shaped shaft 10, its outer diameter of its four sides is slightly smaller than the diameter of inner encased cylinder 11 for tape roll. In two of the four indented portions of the X-shaped shaft 10, larger and longer circular arc tube sheets 12 which have suitable outward tension are installed respectively in the left and right symmetrical indented parts. The flanges 13 are installed on outer edge of the top of the sheets 12 used for encasing the tape having a standard width. Smaller and shorter circular arc tube plates 14 are installed in the remaining upper and lower symmetrical portions which also have suitable outward tension. The flanges 13 are installed also on outer edge of the top of plates 14 used for encasing the tape having a smaller width (as shown in FIG. 3).

Figure 5:
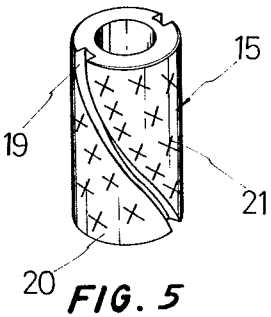
FIG. 5 and FIG. 6 are the shaped views of the applicable examples of the character model rolling cylinder in the present invention.
Figure 6:
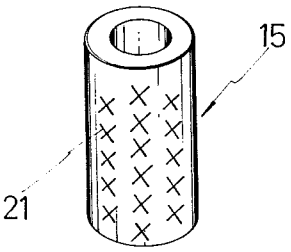
Figure 4:
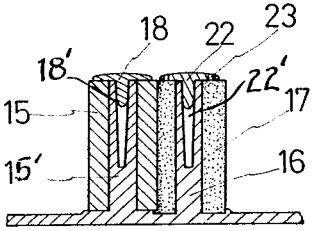
FIG. 4 is a B—B cross-sectional view of FIG. 2 in the present invention.

The printing equipment 6 is installed at left lower part of inner housing 2 (as shown in FIG. 2), which is composed of character model rolling cylinder shaft 15', character model rolling cylinder 15, ink rolling cylinder shaft 16 and ink rolling cylinder 17 (as shown in FIG. 4). The character model rolling cylinder shaft 15' and ink rolling cylinder shaft 16 are integrated with inner housing 2 in parallel but in vertical with respect to the bottom plate of inner housing 2. The center distance between these two parts is slightly smaller than the radius of character model rolling cylinder 15 plus the radius of ink rolling cylinder 17. When these two rolling cylinders encase on two shafts, the surfaces of two rolling cylinder touch each other. The character model rolling cylinder 16 can drive ink rolling cylinder 17 by using friction force to cause rotation. A slightly sloped connecting hole 18' is installed at the center on the top of each the character model rolling cylinder shaft 15' for compressing the fixing plug 18 to fix the position of the character model rolling cylinder 15 connected with this shaft. The character model rolling cylinder 15 is made of suitable material, on which convex characters can be engraved. A shaft hole is installed at its center for encasing and linking to the character model rolling cylinder shaft 15'. The circular edge can include two or more parallel slots 19 (as shown in FIGS. 2, 5 and 6). The slots 19 can be located with center line in parallel or be at a suitable angle. The surface of the rolling cylinder is divided into several convex arc faces 20, on which the convex characters or pitures 21 are installed for printing with ink on the back side of the tapes. A slight sloped connecting hole 22' is also installed at the top of ink rolling cylinder shaft 16 for compressing the fixing plug 22 to fix the position of the ink rolling cylinder 17 encased on this shaft. One or more penetrating ink filling openings 23 are installed on the top of fixing plug 22 for filling the ink in the ink rolling cylinder 17. The ink rolling cylinder 17 is made of fiber or cloth which has strong suction force and which can absorb many types of inks. A shaft hole is installed at the center of cylinder 17 for encasing and linking to ink rolling cylinder shaft 16.

Before use of this invention, the data need only be engraved on the convex arc surface of character model rolling cylinder and the inks prepared in the ink rolling cylinder 17. The applicable method is totally the same as for the conventional automatic tape-cutter.

I claim:

1. In an automatic tape cutter/sticker comprising an outer housing; an inner housing; a side cover; a plate spring; a rotating cutter; a compressing rod; the improvement comprising:

a circular ring tube installed in substantially the center of said inner housing having two upper and lower symmetrical circular arc tube plates, two left and right symmetrical circular arc tube sheets, and an X-shaped fixing shaft, said circular arc tube plates being smaller and shorter than said circular arc tube sheets, said plates and sheets being independent and installed respectively at circular edges of said X-shaped shaft;

printing equipment installed on a bottom plate of said inner housing, said printing equipment comprising a character model rolling cylinder shaft, a character model rolling cylinder, an ink rolling cylinder shaft and an ink rolling cylinder, said character model rolling cylinder shaft being located substantially parallel to said ink rolling cylinder shaft and disposed generally perpendicular to the bottom plate of said inner housing, said character model rolling cylinder shaft and said ink rolling cylinder shaft each having a slightly tapered connecting hole installed at a substantially center portion of the top of the respective cylinder for compressing a fixing plug for fixing the cylinders on the shaft, said character model rolling cylinder and said ink rolling cylinder each having a shaft hole installed at a substantially center position thereof and said character model rolling cylinder having a circular edge comprising at least two parallel slots for dividing the rolling cylinder surface into at least two convex arc faces on which convex characters are installed.

2. The automatic tape cutter/sticker as described in claim 1, wherein the circular arc tube plates and sheets of the circular ring tube have suitable outward tension and have flanges installed respectively on outer edges of top portions of said plates and sheets.

3. The automatic tape cutter/sticker as described in claim 1, wherein at least one penetrating ink filling opening hole is installed on a top side of said fixing plug on the ink rolling cylinder shaft of the printing equipment.

4. The automatic tape cutter/sticker as described in claim 1, further comprising tape.

5. The automatic tape cutter/sticker as described in claim 1, wherein said printing equipment is installed at a lower left side of said bottom plate.

6. The automatic tape cutter/sticker as described in claim 1, wherein said character model rolling cylinder and said ink rolling cylinder are positioned such that the distance between substantially the center of each cylinder is slightly smaller than the radius of the character model rolling cylinder plus the radius of the ink rolling cylinder.

7. The automatic tape cutter/sticker as described in claim 1, wherein said at least two parallel slots are located substantially parallel to a center line of said character model rolling cylinder.

8. The automatic tape cutter/sticker as described in claim 1, wherein said at least two parallel slots are located at a predetermined angle with respect to a center line of said character model rolling cylinder.

9. The automatic tape cutter/sticker as described in claim 1, wherein said ink rolling cylinder is made of ink absorbable fibers.

* * * * *